US006966630B2

(12) United States Patent
Sasaki et al.

(10) Patent No.: US 6,966,630 B2
(45) Date of Patent: Nov. 22, 2005

(54) INKJET HEAD

(75) Inventors: Hiroshi Sasaki, Mito (JP); Yutaka Ito, Takahagi (JP); Ken-ichi Kawashima, Hitachinaka (JP); Makoto Kurosawa, Tokai-mura (JP); Yoshinari Suzuki, Naka-machi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 189 days.

(21) Appl. No.: 10/187,368

(22) Filed: Jul. 2, 2002

(65) Prior Publication Data

US 2003/0097753 A1 May 29, 2003

(30) Foreign Application Priority Data

Jul. 6, 2001 (JP) ..... 2001-206121

(51) Int. Cl.[7] ..... B41J 2/135
(52) U.S. Cl. ..... 347/45; 347/47
(58) Field of Search ..... 347/20, 45, 47, 347/56, 61, 63, 65, 67

(56) References Cited

U.S. PATENT DOCUMENTS

| | | | | |
|---|---|---|---|---|
| 5,759,421 A | * | 6/1998 | Takemoto et al. | 216/27 |
| 6,613,860 B1 | * | 9/2003 | Dams et al. | 528/36 |

FOREIGN PATENT DOCUMENTS

| | | | | |
|---|---|---|---|---|
| EP | 0 539 947 A2 | | 5/1993 | B41J/2/16 |
| EP | 0 889 092 A1 | | 1/1999 | B41J/2/16 |
| JP | 57107848 | * | 7/1982 | 346/146 |
| JP | 63-122550 | | 5/1988 | |
| JP | 01056688 | * | 3/1989 | 556/419 |
| JP | 2-153744 | | 6/1990 | |
| JP | 3-53942 | | 5/1991 | |
| JP | 4-234663 | | 8/1992 | |
| JP | 5-116327 | | 5/1993 | |
| JP | 5-193141 | | 8/1993 | |
| JP | 5-279500 | | 10/1993 | |
| JP | 5-330060 | | 12/1993 | |
| JP | 5-338180 | | 12/1993 | |
| JP | 6-55739 | | 3/1994 | |
| JP | 6-106727 | | 4/1994 | |
| JP | 6-143587 | | 5/1994 | |
| JP | 6-246921 | | 9/1994 | |
| JP | 7-125219 | | 5/1995 | |
| JP | 7-125220 | | 5/1995 | |
| JP | 9-267478 | | 10/1997 | |
| JP | 9-286941 | | 11/1997 | |
| JP | 10-29308 | | 2/1998 | |
| JP | 10-029308 | | 2/1998 | B41J/2/135 |
| JP | 10-337874 | | 12/1998 | |
| JP | 11-268284 | | 10/1999 | |
| JP | 11-277749 | | 10/1999 | |
| JP | 11-311168 | | 11/1999 | |
| JP | 2000-86948 | | 3/2000 | |
| JP | 2001-246756 | | 9/2001 | |
| WO | WO 96/06895 | * | 3/1996 | |
| WO | WO97/35919 | | 10/1997 | |

OTHER PUBLICATIONS

U.S. Appl. No.6,156,824, filed Dec. 2000.

* cited by examiner

*Primary Examiner*—Juanita D. Stephens
(74) *Attorney, Agent, or Firm*—Antonelli, Terry, Stout & Kraus, LLP

(57) ABSTRACT

An inkjet recording head characterized by better ink repellency, greater resistance to abrasion and a longer service life than a conventional product can be attained when an ink repellent layer comprising a compound made up of a perfluoropolyether chain and alkoxysilane residue is formed on the nozzle plate of the inkjet recording head. An inkjet printer for forming an image by jetting out liquid ink, wherein this nozzle plate is employed, becomes substantially maintenance free.

6 Claims, 5 Drawing Sheets

SCHEMATIC CROSS SECTION OF NOZZLE PLATE

SCHEMATIC DIAGRAM OF BONDING BETWEEN INK REPELLENT AGENT WITH A NOZZLE PLATE SURFACE

SCHEMATIC DRAWING OF INKJET PRINTER ACCORDING TO THE PRESENT NVENTION

SIDE VIEW OF CROSS SECTION

TOP VIEW

SCHEMATIC VIEW OF INK REPELLENT LAYER FORMING METHOD FOR NOZZLE PLATE

INKJET HEAD

BACKGROUND OF THE INVENTION

The present invention relates to the recording head of an inkjet printer; and, more particularly, the invention relates to a inkjet head that is compatible for use with ink based on a pigment.

The inkjet printer that forms an image by jetting ink onto paper or an overhead transparency film (OHP sheet) is smaller than an electrophotographic printer, and so it is popularly used in offices, as well as in general households.

When ink is deposited on the surface of a plate (nozzle plate) that is equipped with a nozzle for jetting ink from the inkjet head according to the prior art, the direction of jetting is changed or the jetting volume is reduced, with the result that the inkjetted position tends to deviate or the image density tends to be reduced.

To solve these problems, the current inkjet printer has a mechanism for removing ink deposited on the nozzle plate by wiping the nozzle plate surface with a silicone rubber member or the like, and methods are employed for making the nozzle plate surface ink-repellent.

For making the nozzle plate surface ink-repellent, there is a method of providing the nozzle plate with a plated film containing fine particles of fluorine based resin (disclosed in Japanese Application Patent Laid-Open Publication Nos. Hei 5-193141, Hei 5-116327, Hei 6-246921, Hei 7-125220, Hei 9-286941 and Hei 2000-86948), a method of providing the nozzle plate with a plastic film containing fine particles of fluorine based resin (disclosed in Japanese Application Patent Laid-Open Publication No. Sho 63-122550), a method of providing the nozzle plate with a film composed of silicone material (disclosed in Japanese Application Patent Laid-Open Publication Nos. Hei 4-234663 and Hei 9-267478), a method for providing a fluorine based resin film (disclosed in Japanese Application Patent Laid-Open Publication Nos. Hei 2-153744, Hei 3-53942, Hei 5-330060, Hei 5-338180, Hei 6-55739, Hei 6-106727 and Hei 6-143587) or a method of providing the nozzle plate with a film composed of a silane compound containing a fluoroalkyl group (disclosed in Japanese Application Patent Laid-Open Publication No. Hei 7-125219).

Further, a method is proposed wherein a solution formed by dissolving or dispersing perfluoropolyether in a solvent having a specific chemical structure is coated on the nozzle plate surface of the inkjet printer recording head, whereby ink repellency is provided (W097/35919).

The Japanese Application Patent Laid-Open Publication No. Hei 10-29308 also proposes a technique by which an ink repellent layer formed of a compound comprising a perfluoropolyether chain and alkoxysilane residue is provided on the surface of the nozzle head of an inkjet printer. This Publication also includes a proposal for top-coating the perfluoropolyether on the ink repellent layer in order to further improve the ink repellency.

SUMMARY OF THE INVENTION

However, in the case of the film formed by plating or the aforementioned resin film, the ink repellent layer is as thick as several microns, so the thickness of the film must be taken into account in the design of the nozzle. The diameter of the current nozzle is ten to scores of microns. Thus, the area requiring such a film thickness to be taken into account is 0.5% or more. Namely, when the nozzle diameter is 10 microns, the film thickness must be taken into account, if the film thickness of the ink repellent layer is 50 nm or more. Further, the film thickness varies with changes in the density of the plating liquid or treatment liquid for plastic film formation, and this requires adequate management of density.

In the method of forming a film comprising a silane compound containing fluoroalkyl group, an ink repellent layer can be formed on a single- or multiple-molecular level, so that the film thickness is from a few nanometers to ten nanometers. This eliminates the need for taking the film thickness into account in the design of the nozzle, and ensures easy density management. However, since the resistance to abrasion is small, the ink repellency will be deteriorated if it is wiped by a silicone rubber member or the like repeatedly to clean the surface of the nozzle plate.

Further, in the method of coating a perfluoropolyether compound, or top-coating a perfluoropolyether compound on the ink repellent layer formed of a compound comprising a perfluoropolyether chain and alkoxysilane residue, there is a problem in that the ink repellency is easily deteriorated and the service life of the nozzle is reduced, if it is wiped by a silicone rubber member or the like.

Thus, an object of the present invention is to provide an inkjet head that ensures a higher ink repellency, greater abrasion resistance and longer service life than the prior art.

The aforementioned problems can be solved when a nozzle plate equipped with an inkjetting nozzle, in an inkjet printer recording head for forming an image by jetting liquid ink, has an ink repellent layer formed of a compound comprising a perfluoropolyether chain and alkoxysilane residue.

DETAILED DESCRIPTION OF THE INVENTION (1) Ink Repellent Agent According to the Present Invention The following Chemical Formula 2 is one of the general formulae representing the structure of the ink repellent agent according to the present invention:

$$F\{CF(CF_3)—CF_2O\}_n—CF(CF_3)]Y—Si(OR)_3$$

$$F(CF_2CF_2CF_2O)_n—Y—Si(OR)_3 \qquad \text{[Chemical Formula 2]}$$

where Y denotes a binding site between the perfluoropolyether chain and alkoxysilane residue, and R denotes an alkyl group.

Figure 1:
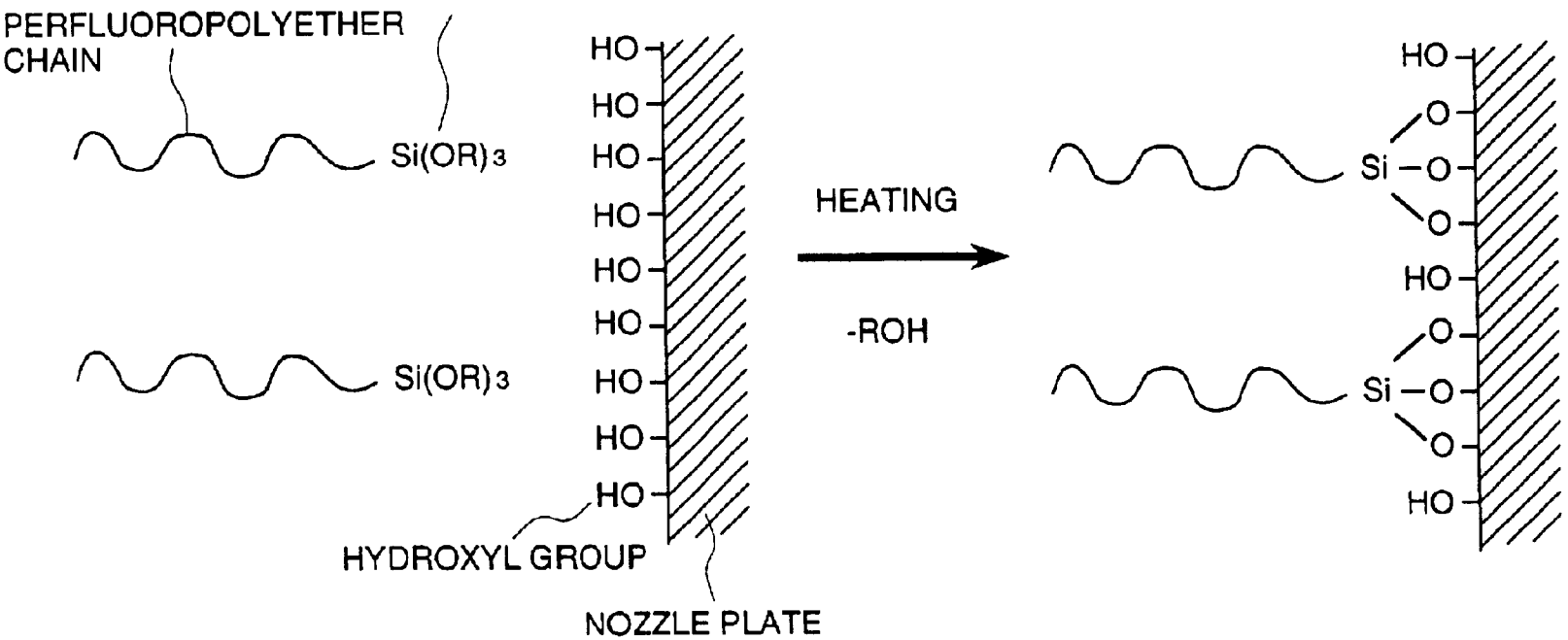
FIG. 1 is a schematic diagram showing bonding between an ink repellent agent and a nozzle plate surface.

The site where the perfluoropolyether chain whose recurring unit is $CF(CF_3)CF_2O$ or $CF_2CF_2CF_2O$, exhibits ink repellency is seen in the structure of the above compound. Ink repellency of this chain is exhibited in both water based ink and oil based ink. Reduction of ink repellency due to abrasion of the surface by a material is smaller than that of a compound having a perfluoropolyether chain. The alkoxysilane residue with the $Si(OR)_3$ at the terminal reacts with hydroxyl group on the surface of the nozzle plate to produce a bonding of O—Si—O, as shown in FIG. 1, with the result that an ink repellent layer, characterized by excellent resistance to abrasion, due to abrasion of the surface by a solid material, is formed on the surface of the nozzle plate.

The portion of —OR in the alkoxysilane residue with the $Si(OR)_2R$ at the terminal reacts in the same way as that of the $Si(OR)_3$, but the portion R does not. Because of this reaction, the ink repellent agent is more closely bonded as the amount of hydroxyl group per unit area is greater on the surface of the nozzle plate. As a result, an ink repellent layer characterized by better resistance to abrasion due to abrasion of the surface by a solid material is formed on the surface of the nozzle plate.

The following describes the method for synthesizing the ink repellent agent (following compounds 1 to 4) falling into the category of the aforementioned general formula:

$$F\{CF(CF_3)—CF_2O\}_n—CF(CF_3)—CONH—(CH_2)_3—Si(OCH_2CH_3)_3$$ [Chemical Formula 3]

Compound 1

$$F\{CF(CF_3)—CF_2O\}_n—CF(CF_3)—CONH—(CH_2)_3—Si(OCH_3)_3$$ [Chemical Formula 4]

Compound 2

$$F(CF_2CF_2CF_2O)_n—CF_2CF_2—CONH—(CH_2)_3—Si(OCH_2CH_3)_3$$ [Chemical Formula 5]

Compound 3

$$F(CF_2CF_2CF_2O)_n—CF_2CF_2—CONH—(CH_2)_3—Si(OCH_3)_3$$ [Chemical Formula 6]

Compound 4

(Synthesis of Compound 1)

Krytox 157FS-L by Dupont (average molecular weight 2500) (25 parts by weight) is dissolved in PF-5080 (100 parts by weight) produced by 3M Co., Ltd., and thionyl chloride is added thereto and is refluxed and stirred for 48 hours. Thionyl chloride and PF-5080 are volatilized by an evaporator to get the chloroformate derivative (25 parts by weight) of Krytox 157FS-L. Then, PF-5080 (100 parts by weight), Saira Ace S330 of Chisso Co., Ltd. (3 parts by weight) and triethylamine (3 parts by weight) are added thereto, this is are stirred at room temperature for 20 hours. The reaction solution is filtered by Radiolite Fineflow A produced by Showa Chemical Industry Co., Ltd. The PF-5080 in the filtrate is vaporized by an evaporator to get the compound 1 (20 parts by weight).

(Synthesis of Compound 2)

Compound 2 (20 parts by weight) was obtained in the same way as the synthesis of Compound 1 except that Saira Ace S360 of Chisso Co., Ltd. (3 parts by 10 weight) was used instead of Saira Ace S330 of Chisso Co., Ltd. (3 parts by weight).

(Synthesis of Compound 3)

Compound 3 (30 parts by weight) was obtained in the same way as the synthesis of Compound 1 except that Demnum SH by Daikin Kogyo (average molecular weight 3500) (35 parts by weight) was used instead of Krytox 157FS-L by Dupont (average molecular weight 2500) (25 parts by weight).

(Synthesis of Compound 4)

Compound 4 (30 parts by weight) was obtained in the same way as the synthesis of Compound 1 except that Saira ACE S360 by Chisso Co., Ltd. (3 parts by weight) was used instead of Saira ACE S330 by Chisso Co., Ltd. (3 parts by weight), and Demnum SH by Daikin Kogyo (average molecular weight 3500) (35 parts by weight) was used instead of Krytox 157FS-L by Dupont (average molecular weight 2500) (25 parts by weight).

The alkoxysilane residue with $Si(OR)_3$ at the terminal of multiple perfluoropolyethers in a molecule reacts with the hydroxyl group on the surface of the nozzle plate to produce a bonding of O—Si—O, as shown in FIG. 1, with the result that an ink repellent layer, characterized by excellent resistance to abrasion, due to abrasion of the surface by a solid material, is formed on the surface of the nozzle plate.

The portion of —OR in the alkoxysilane residue with the $Si(OR)_2R$ at the terminal reacts in the same way as that of the $Si(OR)_3$, but the portion R does not. Because of this reaction, the ink repellent agent is more closely bonded as the amount of hydroxyl group per unit area is greater on the surface of the nozzle plate. As a result, an ink repellent layer, characterized by better resistance to abrasion due to abrasion of the surface by a solid material, is formed on the surface of the nozzle plate.

$$[F\{CF(CF_3)—CF_2O\}_n—CF(CF_3)_2]_2X—Si(OR)_3$$

$$[F\{CF(CF_3)—CF_2O\}_n—CF(CF_3)]_2X—Si(OR)_2R$$

$$\{F(CF_2CF_2CF_2O)_n\}_2X—Si(OR)_3$$

$$\{F(CF_2CF_2CF_2O)^n\}_2X—Si(OR)_2R$$ [Chemical Formula 7]

where X denotes a binding site between the perfluoropolyether chain and alkoxysilane residue, and R denotes an alkyl group.

The following description is directed to a method of synthesizing the ink repellent agent (following compounds 5 to 8) falling into the category of the aforementioned general formula:

[Chemical Formula 8]

$$\begin{array}{l} F\{CF(CF_3)—CF_2O\}_n—CF(CH_3)—CONH—(CH_2)_2—N—(CH_2)_3—Si(OCH_3)_2CH_3 \\ \qquad\qquad\qquad\

-continued

[Chemical Formula 9]

$$F\{CF(CF_3)-CF_2O\}_n-CF(CH_3)-CONH-(CH_2)_2-\underset{\underset{F\{CF(CF_3)-CF_2O\}_n-CF(CH_3)-CO}{|}}{N}-(CH_2)_3-Si(OCH_3)_3$$

Compound 6

[Chemical Formula 10]

$$F(CF_2CF_2CF_2O)_n-CF_2CF_2-CONH-(CH_2)_2-\underset{\underset{F(CF_2CF_2CF_2O)_n-CF_2CF_2)-CO}{|}}{N}-(CH_2)_3-Si(OCH_3)_2CH_3$$

Compound 7

[Chemical Formula 11]

$$F(CF_2CF_2CF_2O)_n-CF_2CF_2-CONH-(CH_2)_2-\underset{\underset{F(CF_2CF_2CF_2O)_n-CF_2CF_2-CO}{|}}{N}-(CH_2)_3-Si(OCH_3)_3$$

Compound 8

(Synthesis of Compound 5)

Krytox 157FS-L by Dupont (average molecular weight 2500) (25 parts by weight) is dissolved in PF-5080 (100 parts by weight) produced by 3M Co., Ltd., and thionyl chloride is added thereto and is refluxed and stirred for 48 hours. Thionyl chloride and PF-5080 are volatilized by an evaporator to get the chloroformate derivative (25 parts by weight) of Krytox 157FS-L. Then, PF-5080 (100 parts by weight), Saira Ace S310 of Chisso Co., Ltd. (2 parts by weight) and triethylamine (3 parts by weight) are added thereto, and this is stirred at room temperature for 20 hours. The reaction solution is filtered by Radiolite Fineflow A produced by Showa Chemical Industry Co., Ltd. The PF-5080 in the filtrate is vaporized by an evaporator to get the compound 5 (20 parts by weight).

(Synthesis of Compound 6)

Compound 6 (20 parts by weight) was obtained in the same way as the synthesis of Compound 5 except that Saira ACE S320 by Chisso Co., Ltd. (2 parts by weight) was used instead of Saira ACE S310 by Chisso Co., Ltd. (2 parts by weight).

(Synthesis of Compound 7)

Compound 7 (30 parts by weight) was obtained in the same way as the synthesis of Compound 5 except that Demnum SH by Daikin Kogyo (average molecular weight 3500) (35 parts by weight) was used instead of Krytox 157FS-L by Dupont (average molecular weight 2500) (25 parts by weight).

(Synthesis of Compound 8)

Compound 8 (30 parts by weight) was obtained in the same way as the synthesis of Compound 5 except that Saira ACE S320 by Chisso Co., Ltd. (2 parts by weight) was used instead of Saira ACE S310 by Chisso Co., Ltd. (2 parts by weight), and Demnum SH by Daikin Kogyo (average molecular weight 3500) (35 parts by weight) was used instead of Krytox 157FS-L by Dupont (average molecular weight 2500) (25 parts by weight).

The average molecular weight is approximately 1000 to 12000, although it depends on the size of a perfluoropolyether chain and the number of the perfluoropolyether chains in a molecule. The formed ink repellent layer is several nanometers thick on the molecular level. The film thickness is obtained by measuring the vibration in CF extension and contraction close to the 1200 kayser, using a non-contact type film thickness measuring instrument (Elipsometer by Mizojiri Optics) or the IR spectrum reflection mode. The result of an experiment by the present inventors has revealed that the surface treated by the ink repellent agent according to the present invention is capable of repelling oil based ink that cannot be dissolved in water or is not easily dissolved in water, in addition to water based ink that is easily dissolved in water.

To form an ink repellent layer using an ink repellent agent, a solution is prepared by diluting an ink repellent agent in a solvent. This solution is applied on the nozzle plate by the brush coating, spray coating, spin coating or dip coating. When it is then heated in the next step, a reaction occurs between the alkoxysilane residue of the ink repellent agent and the hydroxyl group on the surface of the nozzle plate, whereby the ink repellent agent is chemically bonded with the surface of the nozzle plate. In the manner described above, an ink repellent layer is formed. The ink repellent agent according to the present invention is subjected to hydrolysis that occurs when it is brought into contact with water. It is also required that it be able to enter a nozzle having a diameter of 10 to 50 microns. For this reason, the solvent used in the step of preparing a solution to be coated is preferred to be a fluorine based solvent characterized by a low water content and a smaller surface tension. More specifically, such a solvent includes FC-72, FC-77, PF-5060, PF-5080, HFE-7100 and HFE-7200 produced by 3M, and Vertrel XF produced by Dupont.

X or Y denotes the binding site between the perfluoropolyether chain and the alkoxysilane residue. The present invention is not restricted to this portion, but it is preferred to use a structure that avoids hydrolysis even when the ink used is slightly basic. More specifically, a structure containing an amide bond, ether bond, etc. is preferred. Further, a structure without an ester bond and ion bond is preferred.

One of the ways of manufacturing an ink repellent layer formed by an repellent agent is to use the tape shown in the embodiment and a water soluble resin. It is also possible to physically remove the unwanted portions by a plasma ashing or sand blasting method subsequent to formation of an ink repellent layer on all surfaces of the nozzle plate.

(2) Ink Used

The ink used is mainly composed of a coloring agent and a solvent for dispersing or dissolving the coloring agent.

If the coloring agent is a dye, it occurs in a form dissolved in solvent almost completely. In the case of a black color, the nigrosine based compound is used . For other colors, an azo, rhodamine, xanthene or naphtol based compound is used.

By contrast, a pigment occurs in the form dispersed in a solvent. For a black color, carbon black is mainly used. The image formed by this ink has an excellent resistance to light and is suited for long-term storage. However, various types of dispersants are essential to ensure good dispersion in the solvent. Further, a pigment, such as carbon black, has a high degree of hardness, so that it may work as an abrasive. When the aforementioned plate is rubbed by silicone rubber in order to eliminate ink from the surface of the nozzle plate, pigments in the ink may polish the surface of the plate and eventually scrape off the ink repellent layer. To avoid 15 this, it is necessary to provide an ink repellent layer that is capable of withstanding polishing by pigments. For other colors, mention can be made of Pigment Yellow 1, 2, 3, 5,12, 13, 14, 15 and 83, Pigment Orange 1, 5,13, 16, 17 and 24, Pigment Red 1, 2, 3, 4, 5, 7, 9, 12, 22, 23, 37, 38, 48, 49, 50, 51, 53, 57, 58, 60, 63, 81, 83, 88 and 112, Pigment Violet 1, 3, 23 and 2, Pigment Blue 1, 2, 15, 16 and 17, and Pigment Green 2, 7, 8 and 10.

Penetration and dispersion onto paper or an overhead transparency film (OHP sheet) in the step of image formation can be controlled by the surface tension and viscosity of the solvent. If the surface tension is small, the permeation and dispersion tend to increase. If the viscosity is low, the amount of ink emitted from the inkjet head tends to increase.

(3) Nozzle Plate

Figure 2:
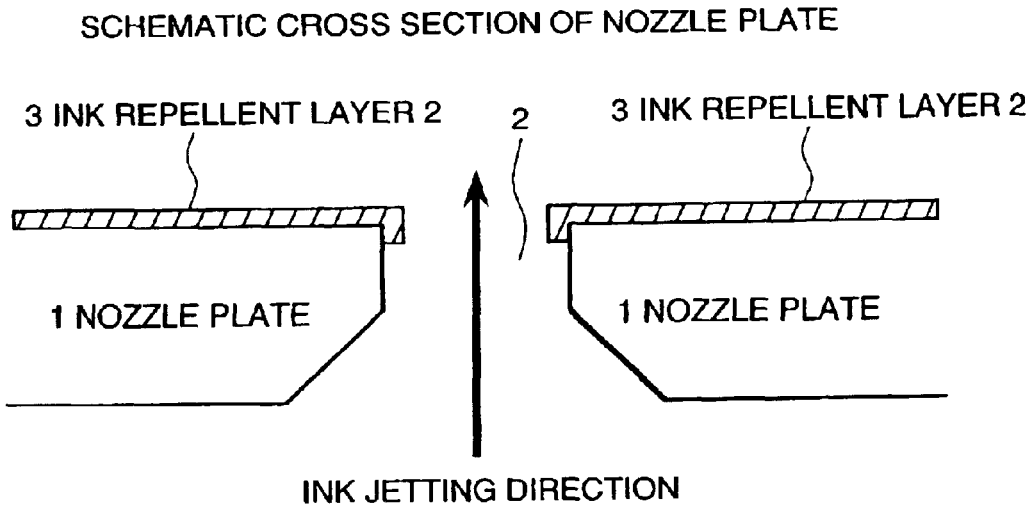
FIG. 2 is a diagram showing a schematic cross section of a nozzle plate.

FIG. 2 shows a schematic cross section of a nozzle plate. The nozzle plate 1 has a nozzle hole 2. An ink repellent layer 3 is provided on the surface of the nozzle plate 1. The ink repellent layer 3 is also provided on part of the inner side of the nozzle hole 2. Ink repellent layers of different depths or extends along the inner side of the nozzle hole from the surface of the nozzle plate were formed for nozzle holes of varying sizes as indicated in Table 1, and inkjetting experiments were conducted using various types of ink. It has been revealed that the preferred depth or extent of the ink repellent layer along the inner surface of the nozzle from the surface of the nozzle slate is less than one fourth of the nozzle diameter. If the depth was gradually increased in excess of one fourth in the experiment, there was a reduction in the amount of ink due to ink repellency, and the inkjetting performance tended to decrease gradually. In this case, however, the resistance to abrasion was superior to that according to the prior art.

The following description is directed to the material of the nozzle plate 1. The nozzle plate 1 preferably contains a great number of hydroxyl groups for reaction with an ink repellent agent. For this purpose, a metallic material is preferred. Especially, it is preferred for the nozzle plate to contain much iron and chromium. However, when the ink is water-based, the moisture content in the air is more likely to dissolve therein than when it is oil-based. This may cause corrosion of the nozzle. For these reasons, stainless steel is preferred as a material of the nozzle plate 1 when rust prevention is taken into account. More specifically, mention can be made of austenitic SUS201, SUS202, SUS301, SUS302, SUS303, SUS303e, SUS304, SUS304L, SUS304N1, SUS304N2, SUS304LN, SUS305, SUS309S, SUS310S, SUS316, SUS316L, SUS316N, SUS316LN, SUS316J1,SUS316J1L, SUS317, SUS317L, SUS317J1, SUS321, SUS347, SUSXM7, SUSXM15J1 and SUS329J1, ferritic SUS405, SUS410L, SUS430, SUS430F, SUS434, SUS447J1 and SUSXM27, martensitic SUS403, SUS410, SUS410J1, SUS416, SUS420J1, SUS420F, SUS431, SUS440A, SUS440B, SUS440C and SUS440F, and precipitation hardening SUS630 and SUS631, as examples of the material used for the nozzle plate. When a rust preventive agent is added, it is possible to use an iron-nickel alloy or others that are susceptible to chemical attack. When the base material of the inkjet head housing is a silicon wafer, and the housing and nozzle are bonded together using thermosetting type adhesive, it is preferred to use an alloy having a ratio of 50 through 65 versus 35 through 50—the same as that of the iron-nickel alloy whose thermal expansion rate is close to that of the silicon wafer.

A hydroxyl group can be introduced by oxygen plasma or the like as a material other than metal. This material includes an inorganic material, such as silicon wafer and zirconium oxide, and a resin, such as polyimide and polypropylene. The preferred material is one that does not dissolve nor swell when brought in contact with the ink to be used.

(4) Inkjet Head

Figure 3A:
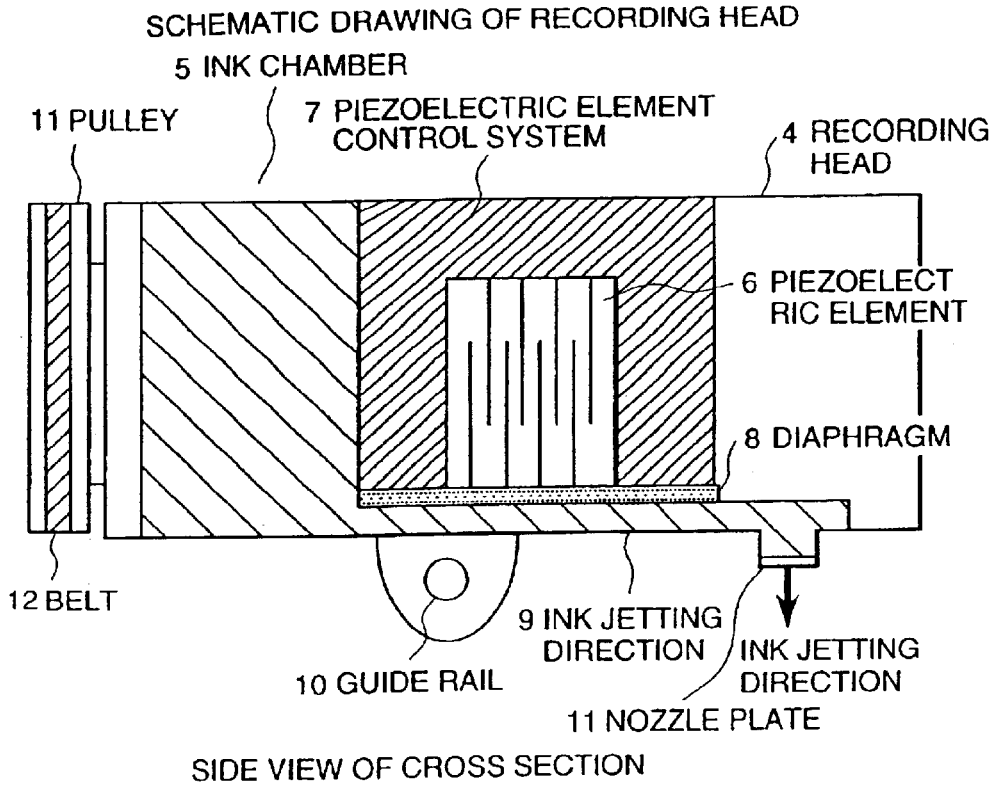
FIGS. 3(A) and 3(B) are schematic drawings showing a side view in a cross-section and a top view, respectively, of a recording head.
Figure 3B:
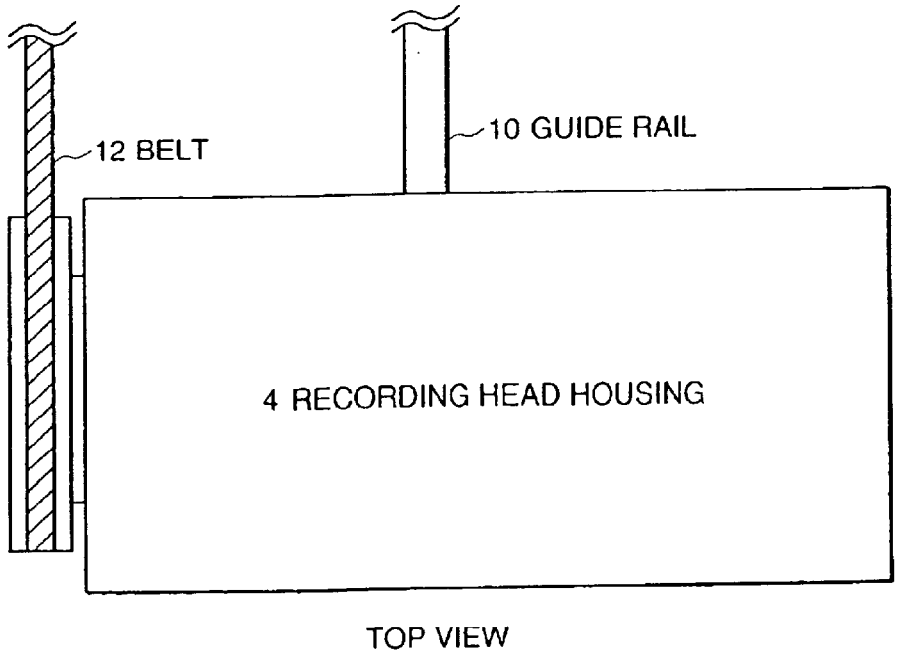

FIGS. 3(A) and 3(*b*) are schematic diagrams showing a cross section of the inkjet head.

As seen in FIGS. 3(A) and (B), the recording head includes a recording head housing 4, an ink chamber 5, a piezoelectric element 6, a piezoelectric element control system 7, a diaphragm 8, an ink flow path 9, a recording head guide rail 10, a pulley 11 and a belt 12.

When the recording head is filled with ink, ink is fed close to the nozzle from the ink chamber 5 through the ink flow path 9. At the time of image formation, the diaphragm 8 is deformed by the pressure of the piezoelectric element. This reduces the volume of the ink flow path 9, with the result that ink is jetted out of the nozzle. The jetted ink is deposited on the paper or an overhead transparency film to form an image thereon.

(5) Inkjet Printer

Figure 4A:
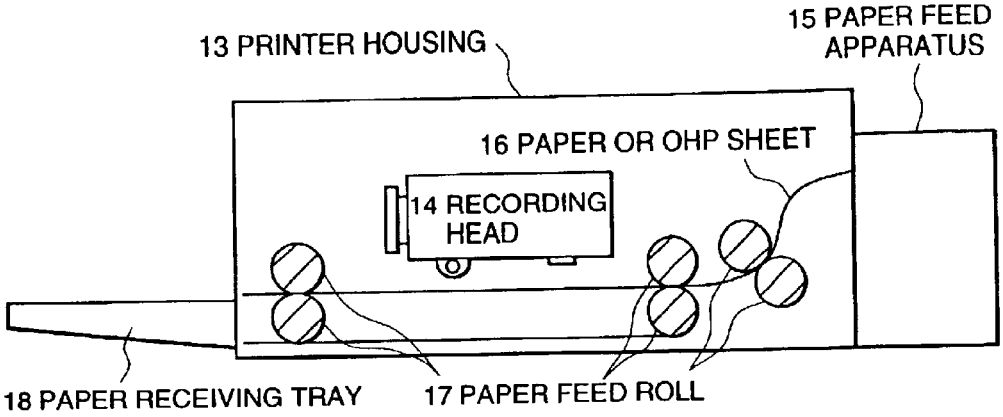
FIGS. 4(A) and 4(B) are schematic drawings sowing a side view in cross-section and a top view, respectively, of an inkjet printer in accordance with the present invention.
Figure 4B:
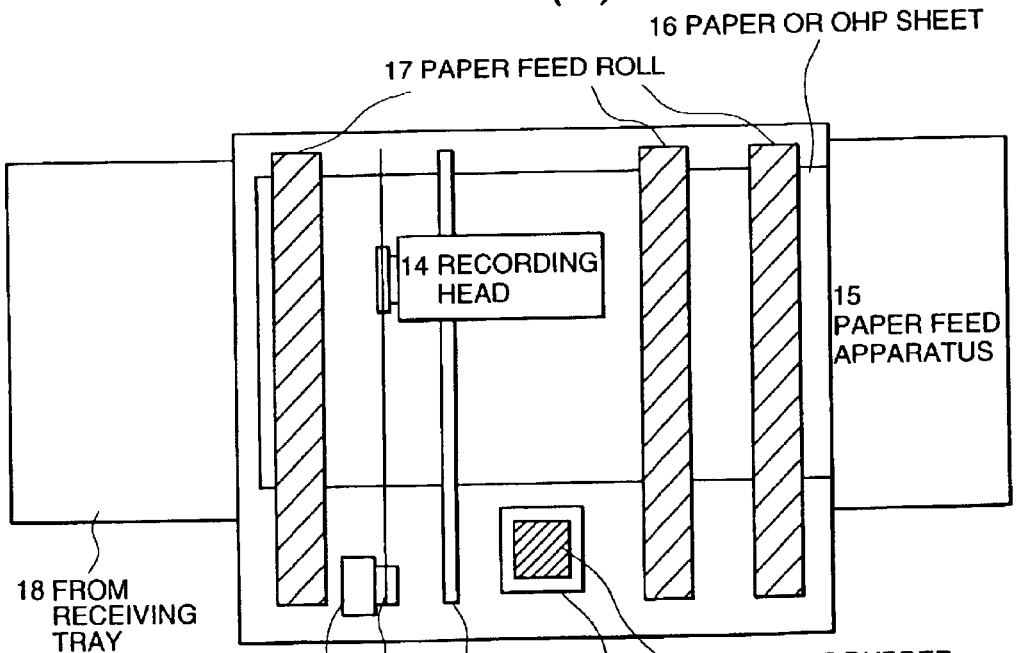

FIGS. 4(A) and 4(B) are schematic diagrams of the inkjet printer.

As seen in FIG. 4(A) and 4(B), the printer has a guide rail 10, a belt 12, a printer housing 13, a recording head 14, a paper feeder 15, paper or an overhead transparency film 16, a paper feed roll 17, a paper receiving tray 18, a belt drive motor 19, a silicone rubber plate 20 for head cleaning, and a base 21 for the silicone rubber plate 20.

An image is formed by appropriately controlling the discharge of ink, the movement of the recording head 17 and the operation of the paper feed mechanism. The ink deposited on the nozzle plate of the recording head 14 is rubbed against the silicone rubber plate 20 that is provided for cleaning, and this ink is removed.

The following provides a more specific description of the present invention with reference to various embodiments. It should be noted, however, that the present invention is not restricted thereto.

(Embodiment 1)

Figure 5:
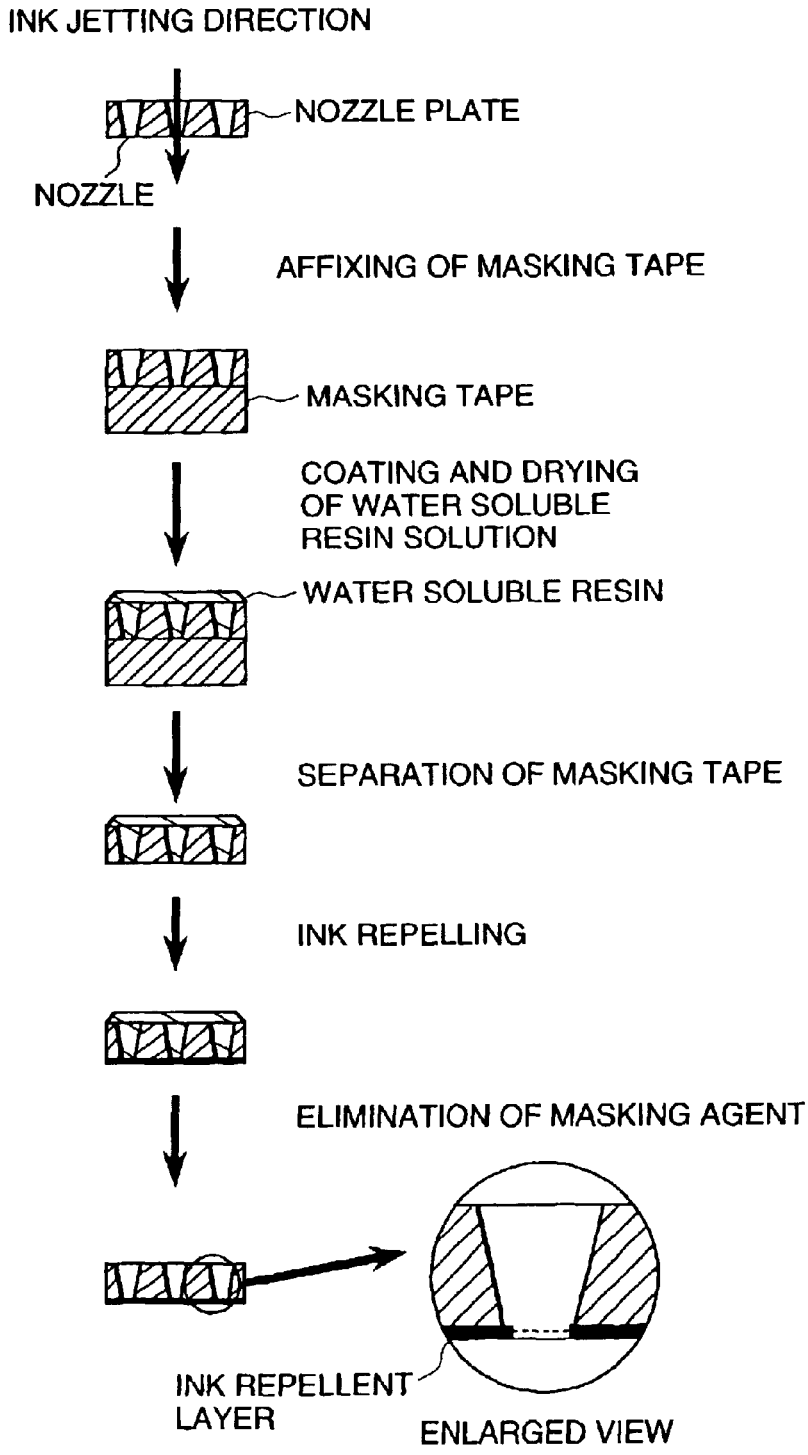
FIG. 5 is a schematic flow diagram representing an ink repellent layer formation procedure for producing a nozzle plate.

FIG. 5 is a process flow diagram which illustrates the method of forming an ink repellent layer on the surface of a nozzle plate equipped with an inkjet nozzle.

In the following description, the surface of the head having an inkjet nozzle thereon will be called a front surface, while the surface without the inkjet nozzle will be called a rear surface.

In a test, various industrial tapes masking (made by 3M) were affixed on the front surface of SUS304-made 80-micron thick nozzle plates (having nozzle diameters of 30, 40 and 60 microns). A pressure of 10 kg/cm$^2$ was applied thereon for 30 seconds. Six types of 3M-made industrial tapes, No. 966, 4485, Y4627, 4016, MIX-801 and 1060 were used for each nozzle plate in the test. As will be described later, the depth of the masking inside the nozzle varied according to the type of the tape. Then, a 15 wt % aqueous solution of the polyvinyl alcohol produced by Wako Junyaku Co., Ltd. (number of repeating unit: 1500) as a water soluble resin was applied on the rear surface. After the polyvinyl alcohol had dried up, the masking tape was removed and the nozzle plate was dipped in 3M-made PF-5080 solution (having a concentration of 0.5 wt %) of Compound 1 for ten minutes. After that, it was heated at 120 degrees Celsius for 20 minutes. Then, this nozzle plate was put in a beaker filled with water at 80-degrees Celsius, and it was subjected to vibration by an ultrasonic cleaner for ten minutes. The water was then replaced, and the plate was subjected to vibration for ten minutes. After these steps were repeated four times, the polyvinyl alcohol was eliminated. In this way, a nozzle plate was produced, having an ink repellent layer formed on the surface having the inkjet nozzle. The contact angle of the produced nozzle plate surface with the water on the ink repellent layer was 115 to 117 degrees, and the contact angle with the ink (surface tension: 50 mN/m) used for subsequent image formation was 90 to 92 degrees. The thickness of the ink repellent layer was 4 to 5 nm, according to a measurement carried out using an Elipsometer of Mizojiri Optics.

The nozzle plate thus produced was mounted on the inkjet head shown in FIG. 3, and this inkjet head was further mounted on the inkjet printer shown in FIG. 4 to start a printing operation. As a result, it was found that the situation varied according to the masking tape being used and the nozzle diameter. An excellent image was formed under the conditions shown in the crosshatched portion of the following Table 1. The density of the image was slightly low in some cases. Nigrosin based dye was used as a pigment of the ink.

TABLE 1

Depth of ink repellent layer inside the nozzle

| Table No. | Nozzle diameter (microns) | | |
|---|---|---|---|
| | 30 | 40 | 60 |
| 966 | 1 | 2 | 4 |
| 4485 | 3 | 5 | 6 |
| Y4627 | 5 | 7 | 10 |
| 4016 | 7 | 10 | 14 |
| MIX-802 | 8 | 11 | 15 |
| 1060 | 9 | 12 | 17 |

In Table 1, depth is given in terms of microns.

Thus, an ink repellent layer was assumed to have been formed on the-portion without ink deposited thereon, and as not having been formed on the portion with ink deposited thereon. The nozzle plate was cut off at the middle of the nozzle to ensure visibility inside the nozzle for observation. Then, the ink-deposited portion inside the nozzle was examined. The result of this observation is shown in Table 1. In any of the inkjet heads, it was made clear that the preferred depth or extent of the ink repellent layer along the inner surface of the nozzle from the surface of the nozzle plate is less than one fourth of the nozzle diameter. When the depth was gradually increased in excess of one fourth of the nozzle diameter, the inkjetting performance tended to reduce gradually. In this case, however, the resistance to abrasion was superior to that according to the prior art.

After printing, the nozzle plate of the injection head was rubbed against the silicone rubber inside the inkjet printer at a pressure of 60 g/cm$^2$ reciprocation of the head for head cleaning, under the conditions shown in the crosshatched portion. The results produced by this experiment will be described below. By the aforementioned step, a small amount of ink deposited on the surface of the nozzle plate was removed. After printing, the head cleaning operation (hereinafter referred to as an "abrasion resistance test") was repeated 10,000 times. As a result, it was found, after 10,000 abrasion resistance tests, that a small amount of ink deposited on the surface of the nozzle plate could be removed by head cleaning. The contact angle of the nozzle plate with water subsequent to 10,000 tests was 98 to 100 degrees, and that with ink was 73 to 75 degrees.

The aforementioned head cleaning operation may be performed under normal operating conditions when the switch is turned on and at every printing of about ten sheets. If the switch is turned on once a day and 300 sheets are printed in a day, the inkjet head of the present embodiment ensures a long-term service life of 2500 days, namely, almost seven years under normal operating conditions.

The inkjet printer in the present embodiment uses a highly durable inkjet head that does not require replacement for 2500 days, namely, almost seven years under normal operating conditions. This demonstrates that the inkjet printer in the present embodiment provides a virtually maintenance-free apparatus.

Reference Example 1

The same experiment as that carried out in Embodiment 1 was conducted, except that, instead of Compound 1, use was made of 1H, 1H, 2H, 2H-perfluorododecyl triethoxy silane provided by Hydras Chemical (hereinafter referred to as "Compound 9") containing a perfluoroalkyl chain as a site for exhibiting ink repelling action and alkoxysilane residue for bonding with the nozzle surface.

$$F(CF_2)_8—(CH_2)^2—Si(OCH_2CH_3)_3 \quad \text{[Chemical Formula 12]}$$

The thickness of the ink repellent layer was 4 to 5 nm when measured by an Elipsometer produced by Mizojiri Optics.

The inkjet head obtained in the aforementioned procedure was subjected to abrasion resistance tests to examine the resistance to abrasion by a silicone rubber member. Insufficient cleaning was recorded subsequent to the 30th test, and ink drops were observed to remain on the surface of the nozzle plate. The angle of contact with the nozzle plate at this time was measured, and it was found to have been reduced. Namely, the contact angle with water was 52 to 65 degrees, and that with ink was 23 to 27 degrees.

At the end of the 100th abrasion resistance test, the nozzle plate surface almost ceased to repel ink any more, with almost all of the ink remaining unremoved. The contact angle of the nozzle plate was measured after the 100th test, and it was 10 found that the angle of contact with water was 40 to 43 degrees and that with ink was 12 to 15 degrees, representing a drastic reduction.

(Embodiment 2)

The same experiment as that carried out in Embodiment 1 was conducted, except that black pigment ink (with carbon black as a coloring agent at the surface tension of 50 mN/m) was used instead of dye ink.

The inkjet head obtained in the aforementioned manner was subjected to 10,000 abrasion resistance tests. As a result, it was found that a small amount of ink deposited on the surface of the nozzle plate could be removed by the head cleaning operation after about the 10,000th abrasion resistance test in the case of any of the nozzle plates. Subsequent to the 10,000th test, the contact angle of the nozzle plate with water was 82 to 85 degrees and that with ink was 61 to 63 degrees. Prior to the test, the contact angle of the nozzle plate with water was 115 to 117 degrees, and that with ink was 90 to 92 degrees. Table 2 shows the results:

TABLE 2

| Number of Tests | Contact angle of nozzle plate before and after abrasion resistance test | | | |
|---|---|---|---|---|
| Medium for measuring | 0 | | 10000 | 30000 |
| contact angle | Water | Ink | Ink | Ink |
| Compound 1 | 115 to 117 | 90 to 92 | 61 to 63 | 11 to 15 |
| Compound 2 | 115 to 117 | 90 to 92 | 61 to 64 | 11 to 14 |
| Compound 3 | 117 to 120 | 92 to 93 | 68 to 72 | 26 to 30 |
| Compound 4 | 117 to 120 | 92 to 93 | 68 to 72 | 26 to 30 |
| Compound 5 | 116 to 119 | 91 to 93 | 77 to 80 | 60 to 64 |
| Compound 6 | 116 to 119 | 91 to 93 | 77 to 81 | 60 to 65 |
| Compound 7 | 118 to 120 | 93 to 95 | 83 to 88 | 72 to 75 |
| Compound 8 | 118 to 120 | 93 to 95 | 84 to 89 | 72 to 77 |

Contact angles are given in terms of degrees.

Reference Example 2

The same experiment as that carried out in Embodiment 2 was conducted, except that, instead of Compound 1, use was made of Compound 9 containing a perfluoroalkyl chain as a site for exhibiting an ink repelling action and alkoxysilane residue for bonding with the nozzle surface.

The inkjet head obtained in the aforementioned manner was subjected to an abrasion resistance test to examine the resistance to abrasion against a silicone rubber member. Insufficient cleaning was recorded subsequent to the 5th test, and ink drops were observed to remain on the surface of the nozzle plate. The angle of contact with the nozzle plate at this time was measured, and it was found that the contact angle with water was 51 to 66 degrees, and that with ink was 22 to 26 degrees.

At the end of the 15th abrasion resistance test, the nozzle plate surface almost ceased to repel ink any more, with almost all of the ink remaining unremoved. The contact angle of the nozzle plate was measured after the 15th test, and it was found that the angle of contact with water was 38 to 40 degrees and that with ink was 10 to 12 degrees, representing a drastic reduction.

(Embodiment 3)

The same experiment as that carried out in Embodiment 2 was conducted, except that Compounds 2 to 8 were used instead of Compound 1.

The inkjet head obtained in the aforementioned manner was subjected to 10,000 abrasion resistance tests. As a result, it was found that a small amount of ink deposited on the surface of the nozzle plate could be removed by the head cleaning operation after about the 10,000th abrasion resistance test in the case of any of the nozzle plates. Subsequent to the 10,000th test, the contact angle of the nozzle plate with ink was 61 to 89 degrees. Prior to the test, the contact angle of the nozzle plate with water was 115 to 120 degrees, and that with ink was 90 to 95 degrees. Table 2 shows the results of measuring the aforementioned contact angles given together. The thickness of the ink repellent layer formed with Compounds 2 to 8 was 4 to 8 nm when measured by an Elipsometer produced by Mizojiri Optics.

It has been demonstrated that the inkjet head of the present embodiment ensures a long-term service life of 2500 days, namely, almost seven years under the normal operating conditions, similar to the cases of Embodiments 1 and 2.

The inkjet printer in the present embodiment uses a highly durable inkjet head that does not require replacement for 2500 days, namely, almost seven years under normal operating conditions. This demonstrates that the inkjet printer of the present embodiment provides a virtually maintenance-free apparatus.

(Embodiment 4)

The same experiment as that carried out in Embodiments 2 and 3 was conducted, except that 30,000 abrasion resistance tests were made. As a result, it has been revealed that ink was observed to remain on the nozzle plate having treated compounds 1 and 2 even when it had been wiped off by the silicone rubber member. A light amount of ink was also observed to remain on the nozzle plate having treated compounds 3 and 4 when it had been wiped off by the silicone rubber member, although the amount of ink was smaller than that on the nozzle plate having treated compounds 1 and 2. By contrast, ink could be wiped off and removed from the nozzle plate having treated compounds 5 to 8, similar to the case prior to the abrasion resistance test. Table 2 also indicates the contact angle of the nozzle plate with ink, subsequent to the abrasion resistance test. The contact angle of the nozzle plate having treated compounds 5 to 8 was 60 to 77 degrees. By contract, the nozzle plate having the treated compounds 1 to 4 was 11 to 30 degrees, showing reduced angles.

When 300 sheets are to be printed in a day, it has been demonstrated that a long service life of 7500 days, namely, 20 years or more under the normal operating conditions, can be ensured by the inkjet head comprising an ink repellent layer formed on the nozzle plate, where this layer consists of a compound such as compounds 5 to 8, with multiple perfluoropolyether chains contained in the molecule.

The inkjet printer in the present embodiment uses a highly durable inkjet head that does not require replacement for 7500 days, namely, twenty years and more under normal operating conditions. This demonstrates that the inkjet printer in the present embodiment provides a virtually maintenance-free apparatus.

(Embodiment 5)

The nozzle plate was dipped in 15-wt % nitric acid for ten seconds, and then it was immediately washed in water to remove the nitric acid. Then water deposited on the nozzle plate was evaporated by dry nitrogen. After that, the same experiment as that carried out in Embodiment 2 was conducted. However, only the compounds 1 to 4 exhibiting a poor abrasion resistance in experiment 3 were used as ink repellent agents. The thickness of the ink repellent layer was 6 to 10 nm when measured by an Elipsometer produced by Mizojiri Optics.

In 30,000 abrasion resistance tests, a reduction in ink repellency was observed on the nozzle plate where only compounds 1 to 4 were treated, as shown in Embodiment 3. By contrast, when the nozzle plate was dipped in nitric acid in advance, ink could be removed by wiping, similar to the case prior to the abrasion resistance test.

Table 3 shows the contact angle of the nozzle plate with ink before the abrasion resistance test.

TABLE 3

| Treatment Conditions Number of abrasion resistance tests | Contact angle of nozzle plate after 30000 abrasion resistance test: Dipped in nitric acid 0 | Dipped in nitric acid 30000 | Irradiation of oxygen plasma 0 | Irradiation of oxygen plasma 30000 |
|---|---|---|---|---|
| Compound 1 | 91 to 93 | 62 to 65 | 91 to 93 | 60 to 64 |
| Compound 2 | 91 to 93 | 62 to 65 | 91 to 93 | 60 to 64 |
| Compound 3 | 93 to 95 | 71 to 74 | 93 to 95 | 70 to 73 |
| Compound 4 | 93 to 95 | 71 to 74 | 93 to 95 | 70 to 73 |

Contact angles are given in terms of degrees.

The contact angle of the nozzle plate with ink was 62 to 74 degrees, showing that a reduction of the contact angle was smaller than that when there was no step of dipping the nozzle plate into nitric acid.

It has been demonstrated that a long service life of 7,500 days, namely, twenty years or more under normal operating conditions, is ensured by the inkjet head using the nozzle plate where the ink repellent layer consisting of perfluoropolyether compound is formed thereon, after dipping the nozzle plate into nitric acid.

The inkjet printer in the present embodiment uses a highly durable inkjet head that does not require replacement for 7500 days, namely, twenty years and more under normal operating conditions. This demonstrates that the inkjet printer in the present embodiment provides a virtually maintenance-free apparatus.

(Embodiment 6)

The nozzle plate was subjected to oxygen plasma irradiation. After that, the same experiment as that carried out in Embodiment 2 was conducted, provided that only the Compounds 1 to 4 registering a poor result in the abrasion resistance test in Embodiment 3 were used as ink repellent agents.

The equipment used in this experiment was Plasma Usher Model IPC-8005T produced by Dionix with a pressure of 0.1 Torr or less prior to introduction of oxygen into the chamber, and 0.5 Torr subsequent to introduction of oxygen. The output of the high frequency power supply of the equipment was set to 300 watts, and plasma irradiation to the nozzle plate was carried out for 30 seconds. The thickness of the ink repellent layer formed with Compounds 1 to 4 was 6 to 10 nm when measured by an Elipsometer produced by Mizojiri Optics.

In 30,000 abrasion resistance tests, a reduction in ink repellency was observed on the nozzle plate where only compounds 1 to 4 were treated, as described in Embodiment 3. By contrast, when the nozzle plate was subjected to plasma irradiation in advance, ink could be removed by wiping, similar to the case prior to the abrasion resistance test.

Table 3 shows the contact angle of the nozzle plate with ink before the abrasion resistance test.

The contact angle of the nozzle plate with ink was 60 to 73 degrees, showing a smaller reduction than when the nozzle plate was not subjected to plasma irradiation.

It has been demonstrated that a long service life of 7500 days, namely, 20 years or more under the normal operating conditions, can be ensured by the inkjet head using a nozzle plate comprising an ink repellent layer formed thereon after the nozzle plate has been subjected to plasma irradiation, where this ink repellent layer consists of a perfluoropolyether compound.

The inkjet printer in the present embodiment uses a highly durable inkjet head that does not require replacement for 7500 days, namely, twenty years and more under normal operating conditions. This demonstrates that the inkjet printer in the present embodiment provides a virtually maintenance-free apparatus.

(Embodiment 7)

The same experiment as that carried out in Embodiment 5 was conducted, except that the SUS304 was replaced by Fe42Ni. As a result, it has been revealed that ink can be removed by wiping after 30,000 hours of abrasion tests, in the same manner as before such tests.

The contact angle of the nozzle plate with ink was 91 to 95 degrees before the abrasion tests, and 62 to 74 degrees after such tests. The thickness of the ink repellent layer formed with Compounds 1 to 4 was 6 to 10 nm when measured by an Elipsometer produced by Mizojiri Optics.

Similarly to the case of Embodiment 5, the present Embodiment has 2 o demonstrated that, even if the nozzle plate is made of a different material, a long service life of 7500 days, namely, 20 years or more under the normal operating conditions, can be ensured by the inkjet head using a nozzle plate comprising an ink repellent layer formed thereon after the nozzle plate has been dipped in nitric acid in advance, where this ink repellent layer consists of a perfluoropolyether compound.

The inkjet printer in the present embodiment uses a highly durable inkjet head that does not require replacement of a recording head for 7500 days, namely, twenty years and more under normal operating conditions. This demonstrates that the inkjet printer in the present embodiment provides a virtually maintenance-free apparatus.

(Embodiment 8)

The same experiment as that carried out in Embodiment 6 was conducted, except that the SUS304 was replaced by SUS316. As a result, it has been revealed that ink can be removed by wiping after 30,000 hours of abrasion tests, in the same manner as before such tests.

The contact angle of the nozzle plate with ink was 91 to 95 degrees before the abrasion tests, and 60 to 73 degrees after such tests. The thickness of the ink repellent layer formed with Compounds 1 to 4 was 6 to 10 nm when measured by an Elipsometer produced by Mizojiri Optics.

Similar to the case of Embodiment 6, the present Embodiment has demonstrated that, even if the nozzle plate is made of a different material, a long service life of 7500 days, namely, 20 years or more under the normal operating conditions, can be ensured by the inkjet head using a nozzle plate comprising an ink repellent layer formed thereon after the nozzle plate has been subjected to oxygen plasma irradiation in advance, where this ink repellent layer consists of a perfluoropolyether compound.

The inkjet printer in the present embodiment uses a highly durable inkjet head that does not require replacement of a recording head for 7500 days, namely, twenty years and more under normal operating conditions. This demonstrates that the inkjet printer in the present embodiment provides a virtually maintenance-free apparatus.

(Embodiment 9)

The same experiment as that carried out in Embodiment 1 was conducted, except that the ink used was insoluble oil based dye ink where the solvent mainly consisted of a hydrocarbon based compound (with surface tension of 28 mN/m). As a result, it has been revealed that ink can be removed by wiping after 10,000 hours of abrasion tests, in the same manner as before such tests.

The contact angle of the nozzle plate with ink was 64 to 66 degrees before the abrasion tests, and 39 to 42 degrees after such tests.

The present Embodiment has demonstrated that, even if oil based ink is used, a long service life of 2500 days, namely, close to seven years under normal operating conditions can be ensured.

The inkjet printer in the present embodiment uses a highly durable inkjet head that does not require replacement for 2500 days, namely, close to seven years under normal operating conditions. This demonstrates that the inkjet printer in the present embodiment provides a virtually maintenance-free apparatus.

Reference Example 3

The same experiment as that carried out in Embodiment 9 was conducted, except that, instead of Compound 1, use was made of Compound 9 containing a perfuoroalkyl chain as a site for exhibiting ink repelling action and alkoxysilane residue for bonding with the nozzle surface.

The inkjet head obtained in the aforementioned manner was subjected to abrasion resistance tests. After the second test onward, cleaning by the silicone rubber member was insufficient, with ink drops remaining on the surface of the nozzle plate. The contact angle of the portion of the tested nozzle plate with ink was 10 to 15 degrees in this case.

Reference Example 4

The same experiment as that carried out in Embodiment 2 was conducted, except that 0.5 wt % solution of Compound 1, Fonbrin Z-25 by Augimont, Fonbrin Z-03 by Augimont, Demnum S65 by Daikin Kogyo or Krytox 143AA by Dupont S65 by Daikin Kogyo or Krytox 143AA by Dupont (where solvent is PF-5080 by 3M) was used as an ink repellent agent. Fonbrin Z-25, Fonbrin Z-03, Demnum S65 and Krytox 143AA all are compounds comprising a perfluoropolyether chain, but without containing an alkoxysilane residue.

The inkjet head obtained in the aforementioned manner was subjected to abrasion resistance tests to examine the resistance to abrasion by the silicone rubber member. When Fonbrin Z-25, Fonbrin Z-03, Demnum S65 and Krytox 143AA are used, cleaning became insufficient from the 20th test onward, with the result that ink drops remained on the nozzle plate. The contact angle of the nozzle plate with water was 51 to 66 degrees, and that with ink was 22 to 26 degrees, representing reduced values.

When Fonbrin Z-25, Fonbrin Z-03, Demnum S65 and Krytox 143AA were used, ink was hardly repelled from the surface of the nozzle plate at the end of the 100th test, with the result that almost all of the ink remained without being removed. Table 4 shows the result of measuring the contact angle of the nozzle plate with ink.

TABLE 4

Contact angle around 100th abrasion resistance test

| Ink repellent agent | Number of abrasion resistance tests 0 | 1000 | Thickness of ink repellent layer (nm) |
|---|---|---|---|
| Compound 1 | 90 to 92 | 88 to 90 | 4 to 5 |
| Fonbrin Z-25 | 90 to 92 | 12 or less | 6 to 7 |
| Fonbrin Z-03 | 90 to 92 | 12 or less | 4 to 5 |
| Demnum S65 | 90 to 92 | 12 or less | 4 to 5 |
| Krytox 143AA | 90 to 92 | 12 or less | 4 to 5 |

Contact angles are given in terms of degrees, and ink is used to check these contact angles.

The contact angle of the nozzle plate surface treated by compound 1 with ink was 88 to 90 degrees, showing hardly any change from the angle before the test. However, the contact angle of the nozzle plate surface treated by other than compound 1 with ink was 12 degrees, representing a drastic reduction. The thickness of the ink repellent layer formed with them was 4 to 7 nm when measured by an Elipsometer produced by Mizojiri Optics. This is also shown in Table 4.

The aforementioned discussion has shown that, of the compounds containing a perfluoropolyether chain, the compound containing alkoxysilane residue has a high degree of resistance to abrasion.

Reference Example 5

The same experiment as that carried out in Embodiment 2 was conducted, except that, after forming an ink repellent layer with compound 9, 0.5 wt % solution Fonbrin Z-25 by Augimont, Fonbrin Z-03 by Augimont, Demnum S65 by Daikin Kogyo or Krytox 143AA by Dupont S65 by Daikin Kogyo or Krytox 143AA by Dupont (where solvent is PF-5080 by 3M) was coated thereon. In other words, the same experiment as that carried out in Reference Example 2 was conducted, except that the ink repellent layer was formed in a two-layered structure.

The inkjet head obtained in the aforementioned manner was subjected to abrasion resistance tests to examine the resistance to abrasion by the silicone rubber member. Cleaning became insufficient from the 100th test onward, with the result that ink drops remained on the nozzle plate. The contact angle of the nozzle plate with water was 50 to 64 degrees, and that with ink was 20 to 24 degrees, representing reduced values.

When Fonbrin Z-25, Fonbrin Z-03, Demnum S65 and Krytox 143AA were used, ink was hardly repelled from the surface of the nozzle plate at the end of the 300th test, with the result that almost all of the ink remained without being removed. Table shows the result of measuring the contact angle of the nozzle plate with ink after the 300th test. For comparison, Table 5 also shows the contact angle of the surface of the nozzle plate treated with Compound 1.

TABLE 5

Contact angle around 1,000 abrasion resistance test

| Ink repellent layer material | Number of abrasion resistance tests 0 | 1000 | Thickness of ink repellent layer (nm) |
|---|---|---|---|
| Compound 1 | 90 to 92 | 84 to 87 | 4 to 5 |
| Compound 9 + Fonbrin Z-25 | 90 to 92 | 12 or less | 10 to 12 |
| Compound 9 + Fonbrin Z-03 | 90 to 92 | 12 or less | 8 to 10 |
| Compound 9 + Demnum S65 | 90 to 92 | 12 or less | 8 to 10 |
| Compound 9 + Krytox 143AA | 90 to 92 | 12 or less | 8 to 10 |

Contact angles are given in terms of degrees, and ink is used to check these contact angles.

At the end of 300th abrasion resistance test, the contact angle with ink was 84 to 87 degrees in the case of Compound 1 used for treatment, showing almost no change from the value before the test. However, the contact angle of the surface of the nozzle plate treated with other than Compound 1 with ink was 12 degrees, representing a drastic decline. The thickness of the ink repellent layer formed with these materials was 4 to 12 nm when measured by Elipsometer by Mizojiri Optics. This is also shown in Table 5.

It has been shown that the ink repellent layer comprising a compound formed of a perfluoropolyether chain and alkoxysilane residue has a greater resistance to abrasion than the ink repellent layer comprising two layers—a layer formed of a compound made up of a perfluoropolyether chain and alkoxysilane residue, and a layer formed of a compound made up of a perfluoropolyether chain.

The present invention provides an inkjet head characterized by better ink repellency, greater resistance to abrasion and a longer service life than a prior art product.

The present invention also provides an inkjet printer characterized by a minimum replacement of the recording head, because the head is made of a highly durable material.

What is claimed is:

1. An inkjet printer recording head for forming an image by jetting out liquid ink, comprises:

a nozzle plate equipped with an inkjetting nozzle; and an ink repellent layer formed of a compound comprising a perfluoropolyether chain and alkoxysilane residue located on an inside surface of said inkjetting nozzle;

wherein said ink repellant layer extends along the inside surface of said inkjetting nozzle from a surface of said nozzle plate to a position less than one fourth of a diameter of said inkjetting nozzle so as to enable the jetting out of the liquid ink from said inkjetting nozzle substantially without reduction of the jetting out performance thereof.

2. An inkjet head according to claim 1, further characterized in that the perfluoropolyether compound has the following structure:

$$[F\{CF(CF_3)—CF_2O\}_n—CF(CF_3)]_2X—Si(OR)_3$$

$$[F\{CF(CF_3)—CF_2O\}_n—CF(CF_3)]_2X—Si(OR)_2R$$

$$\{F(CF_2CF_2CF_2O)_n\}_2X—Si(OR)_3$$

$$\{F(CF_2CF_2CF_2O)_n\}_2X—Si(OR)_2R$$

where X denotes a binding site between the perfluoropolyether chain and alkoxysilane residue, and R denotes an alkyl group.

3. An inkjet printer comprising an inkjet head according to claim 1.

4. An inkjet head according to claim 1, wherein said ink repellant layer is further located on the surface of said nozzle plate with extends in a direction transverse to the jetting out of the liquid ink from said inkjetting nozzle.

5. An inkjet head according to claim 1, wherein said nozzle plate equipped with said inkjetting nozzle is one of a nitric acid treated and a plasma irradiated nozzle plate.

6. An inkjet head according to claim 5, wherein said nozzle plate having said inkjetting nozzle is a metal nozzle plate.

* * * * *